United States Patent [19]

Humpert et al.

[11] Patent Number: 4,846,207

[45] Date of Patent: Jul. 11, 1989

[54] CONNECTING FITTING FOR A MIXING VALVE AND PROCESS FOR CONNECTING THE VALVE

[75] Inventors: Jürgen Humpert, Hemer; Jan R. Kostorz, Menden, both of Fed. Rep. of Germany

[73] Assignee: Friedrich Grohe Armaturenfabrik GmbH & Co., Hemer, Fed. Rep. of Germany

[21] Appl. No.: 220,770

[22] Filed: Jul. 18, 1988

[30] Foreign Application Priority Data

Jul. 18, 1987 [DE] Fed. Rep. of Germany ..... 3723828

[51] Int. Cl.[4] ..... E03C 1/04; F16K 11/00

[52] U.S. Cl. ..... 137/15; 4/192; 137/270; 137/360; 137/625.4

[58] Field of Search ..... 4/192; 137/15, 270, 137/360, 625.4

[56] References Cited

U.S. PATENT DOCUMENTS

| | | | |
|---|---|---|---|
| 3,823,737 | 7/1974 | Szymanski | 4/192 X |
| 4,572,232 | 2/1986 | Gruber | 137/360 |
| 4,584,723 | 4/1986 | Hussauf | 137/270 X |
| 4,676,270 | 6/1987 | Knapp et al. | 137/270 X |

FOREIGN PATENT DOCUMENTS

| | | | |
|---|---|---|---|
| 177382 | 1/1954 | Austria . | |
| 0119960 | 3/1987 | European Pat. Off. . | |
| 3239924 | 5/1984 | Fed. Rep. of Germany . | |
| 3519652 | 12/1986 | Fed. Rep. of Germany | 4/192 |
| 3519763 | 12/1986 | Fed. Rep. of Germany . | |

*Primary Examiner*—Gerald A. Michalsky
*Attorney, Agent, or Firm*—Herbert Dubno

[57] ABSTRACT

The connecting fitting member for a cold and warm water mixing valve includes a coupler mounted in a structure wall, which has passages for two or more pipe connections and from which additional passages lead for connection of the mixing valve branch in a substantially transverse direction. The housing of the mixing valve has a base surface corresponding to the upper surface of the coupler. This connecting fitting member is improved, since a fitting member is inserted or mounted in the housing of the mixing valve, with which it is possible to reverse the connections for the cold and warm water by a rotation of 180° and to fix the mixing valve in any angular position in the coupler.

11 Claims, 5 Drawing Sheets

CONNECTING FITTING FOR A MIXING VALVE AND PROCESS FOR CONNECTING THE VALVE

FIELD OF THE INVENTION

Our present invention relates to a connecting fitting for a warm and cold water mixing valve or faucet and, more particularly, to a connecting fitting for a warm and cold water mixing valve having a coupler or union mounted in a structure wall with a plurality of passages for two or more pip connections.

BACKGROUND OF THE INVENTION

A connecting fitting for a mixing valve is described in Austrian Patent No. 177 382. A comparatively simple and flat coupler is provided to which the mixing valve is attached with a flanged coupling joint. With this device it is required that the coupler be positioned precisely in the structure wall, since a subsequent adjustment is not possible with the mixing valve mounted.

Furthermore, during installation the pipe system connections for cold and warm water in the concealed coupler can be exchanged or inadvertently switched. This is first noticed chiefly when the mixing valve is connected. To make the correct connections a new installation of pipes is required which is extremely expensive, especially with concealed pipes.

Further, a sanitary valve connecting member is described in European Patent No. 0 119 960, in which a mixing valve with a plug member is insertable in a cavity or hole in a coupler. The coupler should comprise a housing, in which a receiving member is mounted which contains the receiving cavity for the plug member. In this device, indeed, a subsequent correction of exchanged connections and an adjustment of the mixing valve is possible. It is, however, relatively complicated and thus expensive and involves considerable expense in construction. Moreover, a comparatively deep coupler is needed by the required receiving cavity for the plug member.

OBJECTS OF THE INVENTION

It is an object of our invention to provide an improved connecting fitting for a warm and cold water mixing valve which provides an easy adjustability and fit to different installation conditions with simple means.

It is also an object of our invention to provide an installation process for a warm and cold water mixing valve which is easily adjustable to different installation conditions.

It is another object of our invention to provide an improved connecting fitting for a warm and cold water mixing valve with which errors in making cold and warm water connections can be easily reversed without substantial disassembly of the connecting fitting and/or rearrangement of concealed pipes.

SUMMARY OF THE INVENTION

These objects and others which will become more readily apparent hereinafter are attained, in accordance with our invention, in a connecting fitting for a warm and cold water mixing valve with a coupler mounted in or on a structure wall, which has a plurality of passages for two or more pipe connections and from which additional passages branch in a transverse direction for connection of the mixing valve, the housing of the mixing valve having a base surface corresponding to the surface of the coupler.

According to our invention, the coupler can comprise a circular seat surrounding an axis which is perpendicular to a seating surface against which a fitting member can be seated.

The coupler can have hot and cold water bores opening at this surface and disposed symmetrically on opposite sides of this axis.

The fitting member can have at its end turned toward the coupler and engaging in the seat, a pair of inlet ports disposed symmetrically with respect to the axis which can also correspond to the axis of the cylindrical fitting member.

One of these inlet ports communicates through the fitting member with a chamber coaxial with the opposite end face of the fitting member and with the axis thereof for communication, in turn, with one of the inlet passages of the mixing valve.

The other inlet port can communicate with a passage formed in the fitting member and opening radially outwardly thereof for communication, in turn, externally of the fitting member with another inlet passage of the mixing valve which can be provided with means for mixing flows from the two inlet passages before discharging a mixed flow.

Means is provided for securing the housing of the mixing valve and hence the fitting member over which the housing extends in selected angular positions about the axis. Thereby the inlet passages can be connected to the hot and cold water bores by switching the inlet ports of the fitting member communicating therewith and independently of the manner of connection of supply pipes to the coupler.

The process for connecting the warm and cold water mixing valve in the connecting fitting according to our invention, comprises first placing the coupler closed with a pressurization and flushing cover in manufacture in or on the structure wall and connecting the coupler to a plurality of pipes, while the tightness of the seal of the system of pipes is determined by pressurizing with the cover maintaining the seal. After finishing the rough-in work and/or before connection of the mixing valve, the projecting ends of the pipe connectors are severed in the pressurization and flushing cover, e.g. by sawing, and the pipe system is flushed. For spray free capture of the issuing flushing water, a hose is pushed on the pipe connectors which are open. Then the water supply is cutoff and the flushing cover is removed from the coupler so that the mixing valve can be directly connected in the desired position and can be put into operation.

Various other forms of our invention are possible. Depressions can be formed concentric to the hot and cold bores in the seat of the coupler and concentric to the inlet ports of the fitting.

In each of these depressions, a circular seal body or ring can be located so that a tight connection and a nonrotatable mounting of the fitting on the coupler is guaranteed in the mounted position. A nonreturn valve (checkvalve) and/or a protective screen can be mounted in the vicinity of each of the circular bodies. The first and second feed ducts in the housing can be positioned corresponding to the inlet passages as defined approximately coaxial to the bores in the coupler and the second feed duct connected with the side or lateral duct is formed so as to be closable at its upstream end with a stopper or plug.

Furthermore, a sound damper can be provided in an enlarged portion of each of the feed ducts. The coupler can be embedded in a pot-like foam piece.

The coupler can be provided with the pressurization and flushing cover in manufacture which is removed after the installation process is completed. The pressurization and flushing cover can be formed substantially from a circular flanged disk, on which are formed pipe connectors closed at projecting ends coaxial to the passages.

The housing can be provided with a circular flange positioned coaxial to the center axis, with which the attaching means can be brought into contact for attaching the housing to the coupler, e.g. attachment screws or cap screws.

Finally, it should be noted that to provide an auxiliary part to fit the water duct or ducts in mounting, a synchronized shut off and regulator valve has been described in German Open Patent Application No. 32 39 924.

The advantages obtained by our invention include:

(a) that a fitting member is positioned between the mixing valve and the coupler, which by rotation about 180° can feed the desired inflows of warm and cold water into the subsequently added mixing valve according to functional requirements and also the housing of the mixing valve can be rotatable to any desired angular position relative to the fitting member, whereby an inclined position of the water socket and/or the coupler is compensated;

(b) that the parts influencing the operation are located together in the housing of the mixing valve so that only the minimal function of simple water feed is assigned to the water socket and/or the coupler;

(c) that in the rough-in state common functional parts of the mixing valve remain correlated and are not combined with the water socket;

(d) that a safe pressurization or depressurization release and flushing of the operational parts is possible by a combined pressurization and flushing cover;

(e) that because of the arrangement of the operational parts in the housing of the mixing valve an extremely small structure depth of the water socket and/or the coupler is possible; and (f) a highly universal and economical design is guaranteed with the given water flow, since return flow prevention, sound damping, etc. can be assigned exclusively to the housing of the mixing valve according to the requirements.

BRIEF DESCRIPTION OF THE DRAWING

The above and other objects, features and advantages of our invention will become more readily apparent from the following specific description, reference being made to the accompanying highly diagrammatic drawing in which.

SPECIFIC DESCRIPTION

Figure 1:
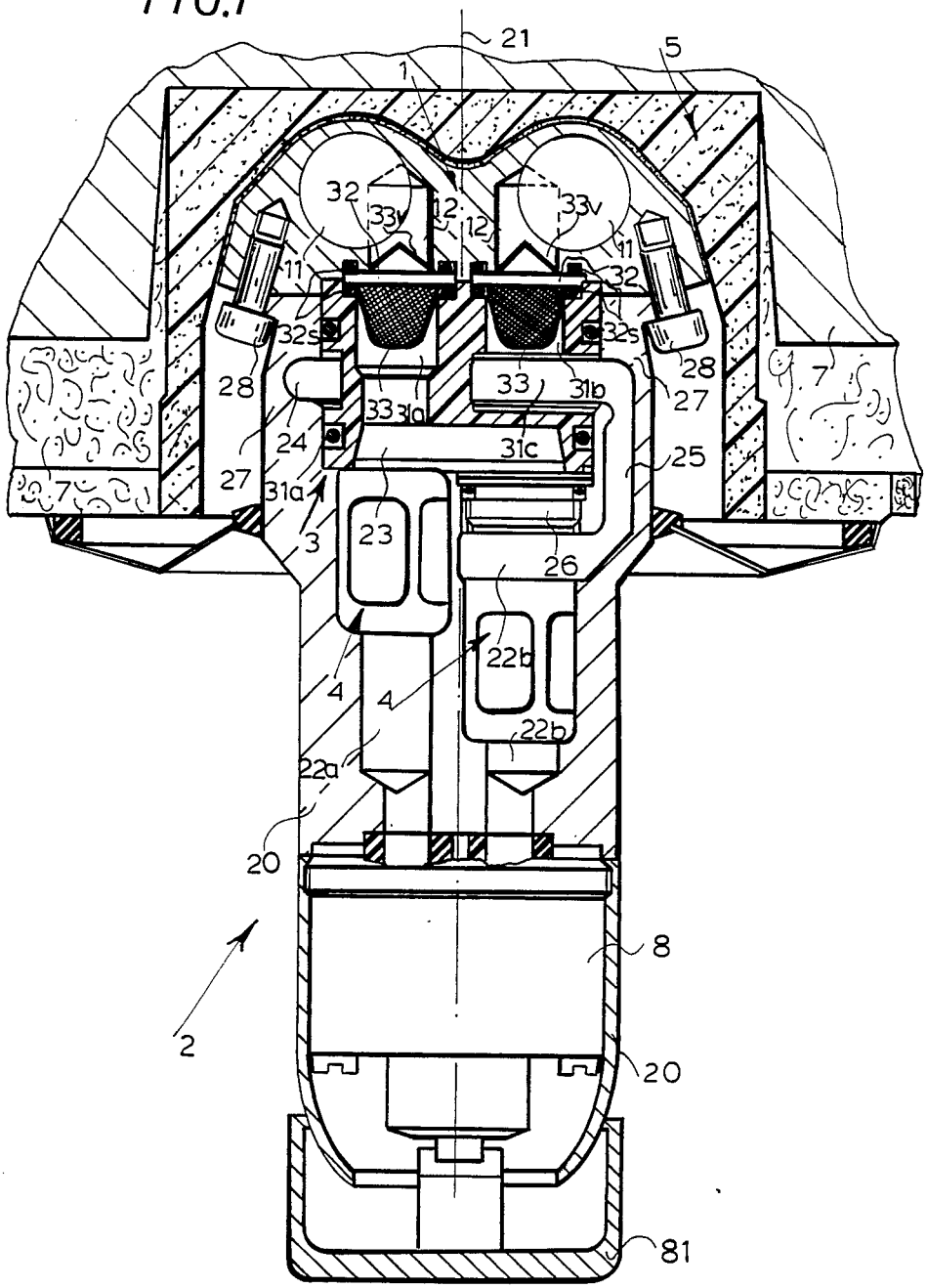
FIG. 1 is a cross-sectional view of a connecting fitting according to our invention, with a connected mixing valve mounted in a structure wall.

The connecting fitting shown in FIG. 1 is mounted in a building wall 7 and comprises a coupler 1, a mixing valve 2, a fitting member 3 and a foam piece 5.

The pot-like foam piece 5 receives the coupler 1 in its hollow space or cavity and abuts against the structure wall 7 to provide acoustic insulation.

The foam piece 5 can be placed or brought directly to the rear side of the coupler 1 so that a united body is produced. The foam piece 5 can also be attached with the coupler 1, e.g. by an adhesive or in another suitable way. The wall of the foam piece 5 protruding from the structure wall 7 can be cut to length appropriately depending on the individual structural depth at the place where the connecting fitting is mounted.

Figure 2:
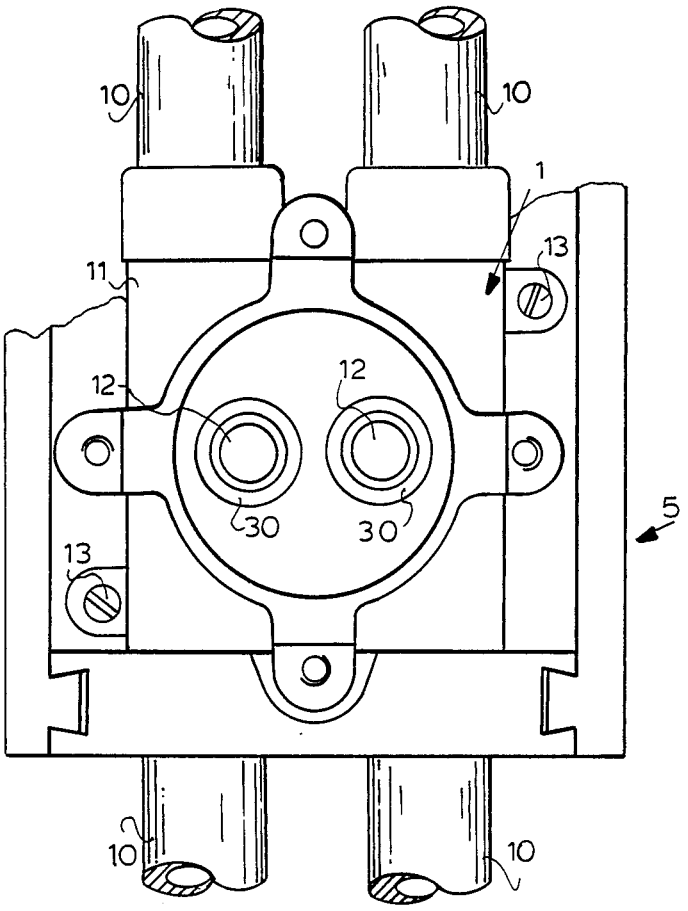
FIG. 2 is a front view of a coupler shown in FIG. 1.

The coupler 1 is, as is apparent from FIG. 2, tightly connected with pipes 10 for cold and warm water and is fixed with the help of crews 13 formed to be sound insulating before embedding in the structure wall 7.

The passages 11 for cold and warm water go through the coupler 1 and are connected with transverse ports 12.

The mixing valve 2 is connected with its housing 20 on the front side. The housing 20 is approximately cylindrical and carries a circular flange 27 on the upstream end with which connection to the coupler 1 is made with the help of four symmetrically positioned attachment screws 28.

Figure 6:
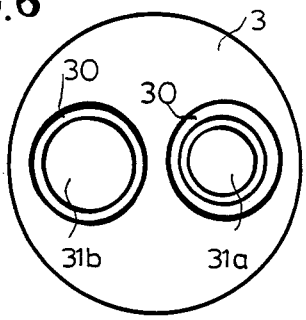
FIG. 6 is a bottom view of the fitting of FIG. 5.
Figure 5:
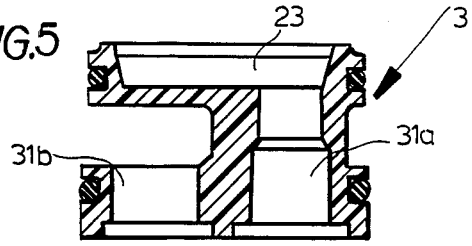
FIG. 5 is a longitudinal cross sectional view of the fitting of FIG. 1.
Figure 7:
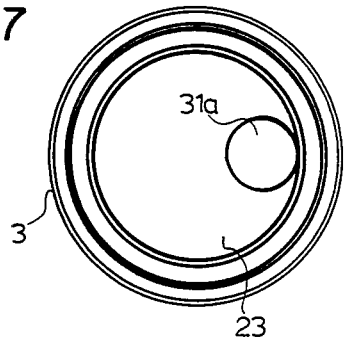
FIG. 7 is a top view of the fitting of FIG. 5.

A cylindrical fitting member 3 is concentrically positioned rotatable in the upstream end of the housing 20. The upstream end of the fitting 3, as is shown especially in FIG. 6, has two separate inlet ports 31*a* and 31*b* which are positioned approximately symmetrically with respect to the center axis 21 and approximately aligned with the bores 12.

The one inlet port 31*a* goes through the fitting member 3 substantially coaxially and opens into a chamber 23 formed concentric to the center axis 21 at the opposite axial end face and which is connected with a first feed duct or passage 22*a* in the housing 20.

The inlet port 31*b* is connected to a passage 31*c* extending radially from the fitting member 3 and opens into a circular duct 24 formed in the housing 20 open to the fitting 3, which is connected with a side duct 25 in the housing 20 which is connected with a second feed duct or passage 22*b*.

The first and second feed ducts 22*a*, 22*b* are connected with a mixing valve 8 mounted in the housing 20. The mixing valve 8 has an adjusting handle 81 movable with two degrees of freedom so that the relative proportions of warm and cold water mixed can be controlled as well as the total flow rate of the mixed warm and cold water.

The fitting member 3 is provided with sealing rings to the housing 20 on its outer surface and with seals 32*s* to the coupler 1 on its front surface so that a premature outflow of cold or warm water or a premature mixing of cold and warm water is prevented.

Also, depressions 30 are provided in the upstream end of the fitting member 3 coaxial to the entrance ducts 31*a* and 31*b*, in which circular bodies 32 are positioned. Depressions 30 are likewise provided in the coupler 1 correspondingly concentric to the passages 12, as can be seen from FIG. 2, so that in the connected position the fitting member 3 is attached nonrotatably with the coupler 1.

A protective screen 33 is attached to the inner portion of the circular body 32 while seals 32*s* are provided on the front side. Besides the protective screen 32, a nonreturn valve 33*v* can be provided in the vicinity of the circular body 32.

A sound damper 4 is located in an enlarged portion of the feed ducts 22*a* and 22*b* behind the fitting member 3 in the flow direction. The widened feed duct 22*b* is closed on its upstream end with a stopper 26 so that a reliable separate feed of warm and cold water is guaranteed.

Figure 3:
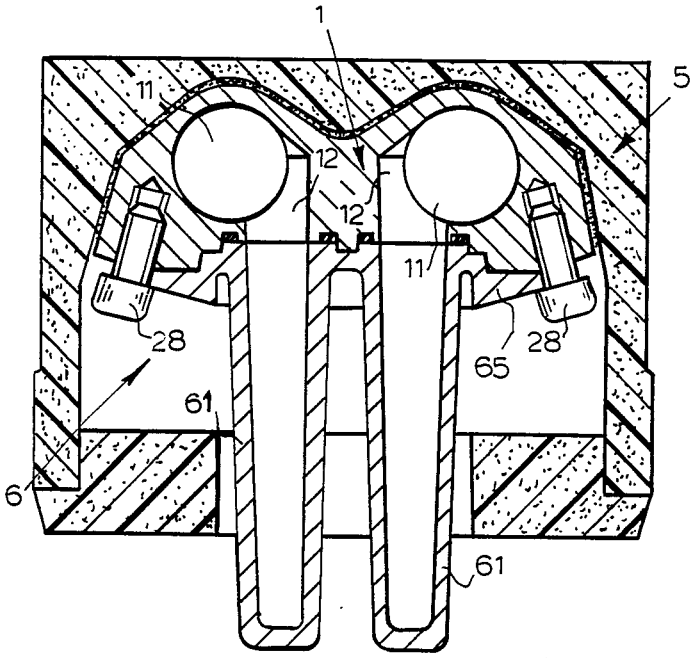
FIG. 3 is a cross sectional view of a manufactured coupler with a pressurization and flushing cover.
Figure 4:
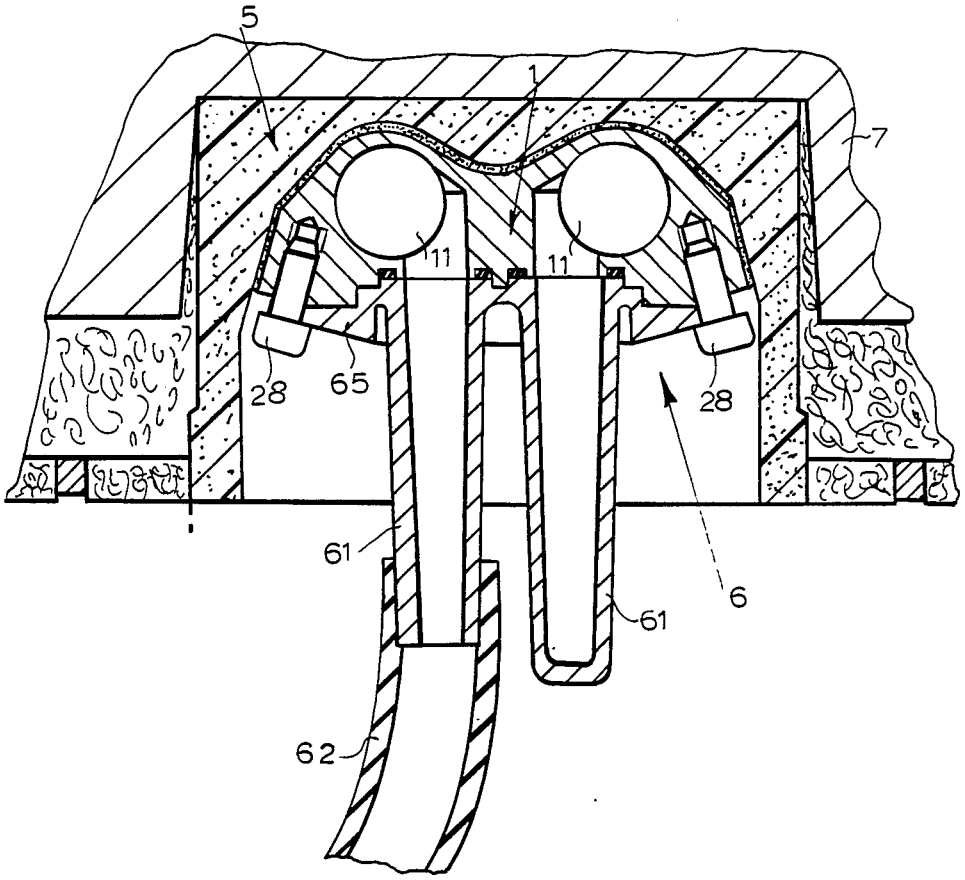
FIG. 4 is a cross sectional view of the coupler of FIG. 3 installed with a hose attached in the flushing position.

The process of connecting the mixing valve can proceed in the following way:

The coupler 1 is provided with a foam piece 5 and a pressurization and flushing cover 6, as is illustrated in FIG. 3. This pressurization and flushing cover 6 substantially comprises a circular flanged disk 65 having protruding pipe connectors 61 closed on their protruding ends. This manufactured coupler 1 is connected with the pipes 10 at the place of assembly, as is illustrated in FIG. 2, and mounted in the structure wall 7. As soon as the pipe installation is finished, the tightness of the pipe system is established with the help of a pressure test, since the passages 11 are indeed sealed reliably in the coupler 1 by the pressurization and flushing cover 6. As soon as the rough-in work is concluded or the mixing valve 2 should be connected to the coupler, the protruding closed ends of the pipe connectors 61 are severed so that now the cold and warm water duct is separately activatable or flushable. A hose 62 can be pushed over the open pipe connectors 61, to catch the issuing flushing water as is indicated in FIG. 4.

After shutting off the flushing process, the attaching screws 28 are released and the pressurization and flushing cover 6 is removed. Now the mixing valve 2 with its housing 20, with its fitting member 3 and the associated seals can be put on the coupler 1 and secured with the attachment screws 28 in the closed mounted configuration.

If, after that, it is determined that the connection of cold and warm water was intended to be laterally reversed, the fitting member 3 is connected in a position rotated about 180 in the coupler 1, after which a correct cold and warm water feed is given. The mixing water outlet of the mixing valve is located under the mixing valve 8 and is not seen in the drawing, especially FIG. 1. By the cylindrical structure of the fitting 3, the housing 20 and with it the mixing water outlet can be fixed in any advantageously vertical angular position independently of the angular position of the coupler 1.

The attaching means for attaching the housing to the coupler 1 in this case comprise the attachment screws 28.

We claim:

1. A connecting fitting for a mixing valve, comprising:

a coupler adapted to be mounted in a building wall and formed with a circular seat surrounding an axis perpendicular to said seat, formed with hot and cold water bores opening at said seat and disposed symmetrically with respect to said axis, and connectable transversely to supply pipes communicating with said bores;

a generally cylindrical fitting member received in said seat and coaxial therewith, said fitting member being formed at one end with a pair of inlet ports positioned to I register with said ports and disposed symmetrically with respect to said axis, and with a chamber coaxial with an end face at an opposite end of said fitting member, said fitting member being receivable in said seat in selective angular positions about said axis;

a mixing valve comprising:

a housing receiving said fitting member and formed with an inlet passage communicating with said chamber, said fitting member having a passage connected with the other of said ports and opening radially of said fitting member, said housing forming with said fitting member a further inlet passage laterally of said fitting member and with which the radially opening passage of said fitting member communicates, said fitting member being received in said housing in selected angular positions about said axis relative thereto, and valve means in said housing connected to said inlet passages for mixing water therefrom and discharging the mixed water; and means for fastening said housing on said coupler in selected angular positions of said housing relative to said coupler whereby either of said inlet passages of said mixing valves is connectable selectively with either of said ports in respective selective relative angular positions of said housing said fitting member and said coupler.

2. The improvement defined in claim 1 wherein depressions are formed in said seat of said coupler and in said fitting member concentric to said bores and ports, respectively, a circular sealing body is being positioned in each depression so that a tight connection and a nonrotatable mounting of said fitting on said coupler is guaranteed.

3. The improvement defined in claim 2 wherein a nonreturn valve is mounted in the vicinity of each of said circular bodies.

4. The improvement defined in claim 2 wherein a screen is mounted in the vicinity of each of said circular bodies.

5. The improvement defined in claim 1 wherein said inlet passages in said housing are positioned approximately coaxial to said bores in said coupler and the inlet passage aligned with said other port is closed at an upstream end by a plug.

6. The improvement defined in claim 1 wherein in each of said inlet passages an enlarged portion receiving a sound damper is provided.

7. The improvement defined in claim 1 wherein said coupler is embedded in a pot-like foam piece.

8. The improvement defined in claim 8 wherein said housing is provided with a circular flange positioned coaxial to said center axis, on which said fastening means for attaching said housing to said coupler are brought into contact.

9. The improvement defined in claim 8 wherein said attaching means for fastening said housing with said coupler comprise attachment screws.

10. A connecting fitting member for a warm and cold water mixing valve having a housing comprising:

a coupler mounted in a structure wall which has a plurality of passages for at least two pipe connections and from which additional passages branch in a transverse direction for connection of said mixing valve, said housing of said mixing valve having a base surface corresponding to a surface of said coupler;

an approximately cylindrical fitting member mounted in said housing, in whose outer end facing said coupler separate entrance ducts for warm and cold water are provided symmetric about a center axis of said mixing valve, one of said entrance ducts being guided approximately coaxially in said outer end and opening into a chamber which is approximately concentric to said center axis, which is connected with a first feed duct of said mixing valve, while the other of said entrance ducts is extended radially from said fitting member and opens into a circular duct open to said fitting member positioned concentrically, which is connected with a second feed duct of said mixing valve with at least one side duct;

means of attaching said housing with said coupler comprising attachment screws which can be brought into contact with a circular flange of said housing so that said housing is attachable in any angular position about said center axis in said coupler; and a pot-like foam piece positioned between said coupler and said structure wall for sound insulation.

11. A process for connecting a warm and cold water mixing valve with a first and second feed duct and a housing in a connecting fitting member having a pot-like foam piece, a coupler, a fitting member between said coupler and said housing and attaching means for mounting said housing on said coupler in any rotational position with said fitting member intervening comprising:

(a) first placing said coupler closed in manufacture with a pressurization and flushing cover having pipe connectors on a structure wall and connecting said coupler to a plurality of pipes;

(b) determining the tightness of seal to said pipes by or releasing pressure;

(c) severing the projecting ends of said pipe connectors in said pressurization and flushing cover and flushing said pipes;

(d) pushing on hose on said pipe connectors for spray free capture of the issuing flushing water; and (e) then removing said pressurization and flushing cover from said coupler so that then said mixing valve can be directly mounted in the desired position and can be put into operation.

* * * * *